US005478423A

United States Patent [19]

Sassa et al.

[11] Patent Number: 5,478,423

[45] Date of Patent: Dec. 26, 1995

[54] METHOD FOR MAKING A PRINTER RELEASE AGENT SUPPLY WICK

[75] Inventors: Robert L. Sassa, Newark, Del.; Alex R. Hobson; Elizabeth M. Hamilton, both of Elkton, Md.; Kristin E. Wiliamson, Bear, Del.

[73] Assignee: W. L. Gore & Associates, Inc., Newark, Del.

[21] Appl. No.: 235,021

[22] Filed: Apr. 28, 1994

Related U.S. Application Data

[63] Continuation-in-part of Ser. No. 127,670, Sep. 28, 1993.

[51] Int. Cl.[6] ..... B31C 13/00

[52] U.S. Cl. ..... 156/187; 118/76; 118/260; 118/264; 118/265; 118/268; 118/60; 222/187; 401/198; 156/215; 492/31; 29/895.211; 29/895.21; 29/895.3

[58] Field of Search ..... 156/324.4, 187, 156/215, 218; 401/198, 199, 218, 219; 222/187; 118/268, 264, 265, 260, 206, 109, 60, 76; 101/348, 331; 29/895.211, 895.21, 895.3; 492/30, 31–48

[56] References Cited

U.S. PATENT DOCUMENTS

| | | | |
|---|---|---|---|
| 3,626,833 | 6/1969 | Koch | 95/89 R |
| 3,640,203 | 2/1972 | Raab et al. | 118/261 |
| 3,767,520 | 10/1973 | Dick et al. | 161/173 |
| 4,047,885 | 9/1977 | Hauman, Jr. | 432/60 |
| 4,141,314 | 2/1979 | Newson | 118/246 |
| 4,182,263 | 1/1980 | Naeser et al. | 118/60 |
| 4,283,448 | 8/1981 | Bowman | 428/36 |
| 4,309,957 | 1/1982 | Swift | 118/60 |
| 4,359,963 | 11/1982 | Saito et al. | 118/60 |
| 4,375,201 | 3/1983 | Kato | 118/60 |
| 4,458,625 | 7/1984 | Sakane et al. | 118/60 |
| 4,496,235 | 1/1985 | Tamany | 118/60 |
| 4,501,483 | 2/1985 | Romansky et al. | 355/3 FU |

(List continued on next page.)

FOREIGN PATENT DOCUMENTS

| | | |
|---|---|---|
| 86023696 | 5/1984 | European Pat. Off. . |
| 0174474 | 8/1984 | European Pat. Off. . |
| 0183903 | 6/1985 | European Pat. Off. . |
| 0240834 | 3/1987 | European Pat. Off. . |
| 0450894 | 4/1991 | European Pat. Off. . |
| 1199972 | 9/1965 | Germany . |
| 58-42465 | 9/1983 | Japan . |
| 59-084273 | 5/1984 | Japan . |
| 60-022160 | 2/1985 | Japan . |
| 60-026973 | 2/1985 | Japan . |
| 62-178992 | 2/1986 | Japan . |
| 62-52302 | 11/1987 | Japan . |
| 63-123077 | 5/1988 | Japan . |
| 63-172186 | 7/1988 | Japan . |
| 2091672 | 9/1988 | Japan . |
| 02144587 | 6/1990 | Japan . |
| 5837541 | 8/1993 | Japan . |
| 9308512 | 4/1993 | WIPO . |

OTHER PUBLICATIONS

ASTM F316–86; pp. 330–338; Pore Size Characteristics of Membrane Filters by Bubble Point and Mean Flow Pore Test.

*Primary Examiner*—David L. Lacey
*Assistant Examiner*—Mark De Simone
*Attorney, Agent, or Firm*—David J. Johns

[57] ABSTRACT

An improved method for making a release agent delivery device for delivery of release agent to a roller is disclosed for use in laser printers, plain paper copiers, facsimile machines, and similar printing apparatus. The delivery apparatus comprises an absorbent textile core filled with release agent, a permeable membrane surrounding the textile core to form a sheathed wick member, and a mounting sleeve adapted to attach the sheathed wick member in operative contact with the printer. The apparatus has numerous operational advantages over existing oil delivery apparatus, including providing multiple contact surfaces for longer operational life before replacement, ease in cleaning and regeneration, improved durability and reduced wear, and more compact and versatile operation.

13 Claims, 7 Drawing Sheets

U.S. PATENT DOCUMENTS

| | | | |
|---|---|---|---|
| 4,573,428 | 3/1986 | Ogino et al. | 118/60 |
| 4,578,338 | 3/1986 | Gruber et al. | 430/120 |
| 4,631,798 | 12/1986 | Ogino et al. | 29/458 |
| 4,668,537 | 5/1987 | Matsuyama et al. | 427/401 |
| 4,743,943 | 5/1988 | Adams, Jr. et al. | 355/3 FU |
| 4,751,548 | 6/1988 | Lawson | 355/3 FU |
| 4,757,347 | 7/1988 | Tamaoki et al. | 219/216 |
| 4,766,456 | 8/1988 | Pirwitz | 355/3 FU |
| 4,777,903 | 10/1988 | Wilcox | 118/60 |
| 4,793,041 | 12/1988 | Jenkins et al. | 29/121.1 |
| 4,942,433 | 7/1990 | Stuart | 355/284 |
| 5,047,809 | 9/1991 | Owada et al. | 355/284 |
| 5,132,739 | 7/1992 | Mauer et al. | 355/284 |
| 5,217,532 | 6/1993 | Sasame et al. | 118/60 |
| 5,232,499 | 8/1993 | Kato et al. | 118/260 |

10,000 AND 30,000 cST OIL LASER WICK EXPONENTIAL FITS

METHOD FOR MAKING A PRINTER RELEASE AGENT SUPPLY WICK

RELATED APPLICATIONS

This application is a continuation-in-part of U.S. patent application Ser. No. 08/127,670, filed Sep. 28, 1993.

BACKGROUND OF THE INVENTION

1. Field of the Invention

The present invention relates to apparatus and method for supplying a release coating to a fixing roller or similar device such as those commonly found in printers and copiers.

2. Description of Related Art

A typical laser printer or plain paper copier contains a series of rollers used to fix toner in place once it has been transferred to paper. Generally two rollers are arranged in contact with one another and rotating in opposite directions—a heated fixing roller and a resilient pressing roller. Once toner has been transferred to a sheet of paper, the paper is passed between the two rollers and toner is heat sealed in place.

In order to assure that the paper does not stick to the heated fixing roller during this procedure, a wick containing a release agent is mounted in contact with the roller along its length. A traditional wick has usually comprised a fibrous strip, such as one comprising "NOMEX®" fiber sold by E. I. duPont de Nemours and Company, Wilmington, Del. These felts can be acquired from conventional industrial fabric suppliers such as Tex Tech Industries of North Monmouth, Me. The felt is presaturated with a release agent of silicone oil (e.g. dimethyl polysiloxane). In addition to assuring separation of the paper and fixing roller during the printing process, the wick also serves as a wiper to clean contaminants, such as residual paper dust, paper additives (e.g. clay, pigments) and offset toner, from the hot fixing roller.

While traditional felt/oil wicks enjoy widespread use due in part to their simplicity and relatively low cost, they are plagued with a number of problems. First, oil impregnated felt tends to provide inconsistent oil release, releasing excess quantities of oil upon initial installation and steadily diminishing to inadequate oil release over time. Second, felt tends to become clogged and caked with toner residue. Residue build up leads to: diminished ability of the felt to deliver oil; reduced effectiveness at cleaning the roller; and increased friction and wear upon the roller. Unfortunately, once contaminated, the matted surface of the felt makes it impractical to clean and requires its disposal. Third, the inability to clean the felt surface also makes it infeasible to attempt to regenerate the wick for reuse, leading to disposal problems and needless waste.

In recognition of some of these problems, a number of modifications to the basic wick design have been proposed. As is explained below, none is believed fully satisfactory.

In U.S. Pat. No. 4,668,537, issued May 26, 1987, to Matsuyama et al. it is proposed to adhere a strip of porous polymer membrane to a felt wick. While this addresses some of the problems inherent with use of a felt wick alone, there are a number of anticipated impediments with this approach. First, proper adhesion of a polymer membrane to a felt surface can be difficult to achieve and delamination in use is a distinct risk. Second, like use of a felt material alone, this device provides only a single contact surface against the fixing roller, which may be subject to premature wear and contamination. Third, the open nature of this device limits the amount of oil which can be loaded into the wick without leakage or clogging around the edge of the porous polymer strip.

Some of these concerns are addressed in U.S. Pat. No. 4,359,963, issued Nov. 23, 1982, to Saito et al. This patent teaches use of a elongated, relatively shallow bag of porous polymer, such as polytetrafluoroethylene (PTFE), filled with heat-resistant felt having silicone oil absorbed therein. Despite improved containment of the oil within the felt, most embodiments of this device continue to be problem prone, including: still supplying only a single contact surface between the wick and the fixing roller; requiring a somewhat difficult attachment of the polymer bag to a mounting frame; and presenting a risk of catastrophic oil leakage if the oil filled bag breaks. Another embodiment taught in this patent proposes use of a rotating polymer-covered felt wick. This approach may provide a better seal of the liquid within the felt, but the rotating movement of the wick against the fixing roller is believed to be less effective at cleaning the fixing roller surface and delivering oil onto the roller surface.

U.S. Pat. No. 4,375,201, issued Mar. 1, 1983, to Kato, employs a hollow tube of extruded porous PTFE which is filled with silicone oil and sealed or covered at both ends to prevent leakage. A coating of fluorocarbon rubber or other material is used to seal the pores in the PTFE tube in those areas not in contact with the fixing roller. While this applicator may address some of the problems of a felt and oil wick, as is discussed below it has a number of other deficiencies.

First, the use of a hollow tube containing a free-flowing reservoir of oil is unacceptable in many instances. For instance, the presence of a liquid reservoir means that the applicator must be kept level in order to have an even distribution of oil across the fixing roller. Additionally, the presence of oil in a free-flowing form presents a risk of leakage and damage to the equipment. To address the leakage problem, the patent teaches the use of sealing mechanisms on either end of the tube; however, such sealing mechanisms still present a risk of leakage and also add unnecessary bulk to the apparatus. Finally, with the loss of oil from the tube in the operation of the wick, undesirable distortion or collapse of the tube is possible.

Second, without the stability of a firm mass of felt or other material in contact with the roller, a hollow, tubular wick is believed to be less efficient at cleaning the roller than conventional felt-based wicks.

Third, the design of the apparatus of U.S. Pat. No. 4,375,201, is believed to add little in the way of increased operational life to the apparatus. Although the device appears capable of refill, this procedure may be far too cumbersome and prone to leakage for widespread acceptance. This conclusion is bolstered by the patent's suggestion that the device may be disposed of after use. Further, in order to avoid leakage, the pores of the applicator are intentionally sealed around most of its periphery to provide only a single roller contact surface. This allows the applicator to be used only so long as this single surface area can be maintained free from wear and residue build-up.

Similar devices are disclosed in U.S. Pat. Nos. 4,573,428, issued Mar. 4, 1986, to Ogino et al. and 4,631,798, issued Dec. 30, 1986, to Ogino et al. Both of these devices employ sealed porous polymer tubes filled with a free-flowing liquid release agent. As such, each is believed to suffer from deficiencies similar to those discussed above. Further, the use of a polyethylene in U.S. Pat. No. 4,573,428, is believed to have a number of additional problems, such as uneven pore structure, increased risk of clogged pores, and possible contamination of heated fixing rollers.

A more complex wick apparatus is disclosed in U.S. Pat. No. 4,459,625, issued Jul. 10, 1984, to Sakane et al. This apparatus provides an open reservoir of release agent which can be repeatedly refilled. Unfortunately, this applicator continues to have only a single contact surface while being substantially bulkier than any of the previously referenced devices. Additionally, the use of free-flowing liquid also presents serious leakage and operational limitations. Finally, this device requires relatively complex assembly techniques in order to create an adequate seal between the roller surface contact and the oil reservoir.

Another problem that has emerged more recently centers around the demand for small, portable high-quality printers and copiers. The particular demands in storage and use inherent in the portable market eliminates use of any release coating applicator which must be maintained in an upright, much less level position. Additionally, the size and weight demands for such equipment requires that the device used be as light, compact and durable as possible.

All of these concerns are addressed by the apparatus disclosed in copending U.S. patent application Ser. No 08/127,670, filed Sep. 28, 1993. In that application it is taught that an improved release agent reservoir and wick can be produced by wrapping an absorptive oil-filled material within a porous expanded polytetrafluoroethylene (PTFE) case. This device demonstrates superior oil transfer properties, providing an even distribution of oil over an extended period of time. The nature of this device allows it to function quite well in a variety of orientations and it is particularly suitable for use in portable machines or other applications that must withstand tilting or rapid movements. Moreover, the expanded PTFE case is particularly wear resistant and even can be rotated to further prolong its operating life.

While the device of the parent application is believed to be a significant improvement over previous release agent supply devices, further improvements are still believed desirable. For instance, the smooth surface of an expanded PTFE membrane casing does not remove excess toner and other particles as thoroughly as might be desired. Further, better control of the rate of supply of release agent is desired.

Accordingly, it is a primary purpose of the present invention to provide an apparatus for applying release chemicals to a roller which is durable, delivers a consistent coating of chemical to the roller, and provides effective cleaning of the roller.

It is a further purpose of the present invention to provide such an apparatus which has improved operational life by being readily adjusted to position multiple contact surfaces between apparatus and the roller.

It is yet another purpose of the present invention to provide an apparatus for applying release chemicals to a roller which is not prone to leakage and which can effectively operate at other than level orientations.

It is another purpose of the present invention to provide an apparatus that has improved cleaning properties, including improved ability to remove excess toner or other deposits from the roller.

It is still another purpose of the present invention to provide an apparatus for applying release chemicals to a roller which can be readily cleaned and reconditioned for reuse.

It is an additional purpose of the present invention to provide straightforward methods to produce and use an applicator with these properties. These and other purposes of the present invention will become evident from review of the following specification.

SUMMARY OF THE INVENTION

The present invention provides an improved applicator apparatus for use in delivering release agent to fixing rollers or similar devices in a variety of printers, including laser printers, plain paper copiers and facsimile machines, etc.

The applicator apparatus of the present invention comprises: an absorbent textile core, such as twisted fiberglass rope or cord, filled with release agent; a permeable membrane, or a permeable membrane with a densified pattern, or a permeable membrane with an irregular surface formed by extrusion, such as expanded polytetrafluoroethylene, surrounding the textile core to form a sheathed wick member; and a mounting sleeve for retaining the sheathed wick member in contact with a fixing roller. Preferably, the sheath wick member comprises an essentially cylindrical unit open at each end which can be rotated to position different faces in contact with the fixing roller. Most preferably, the wick member of the present invention includes a textured surface, such as a densified pattern or irregular surface formed by extrusion or selective densification or expansion, that more effectively removes particles from a roller.

In operation, the apparatus is mounted in contact with a fixing roller in a conventional manner to provide a regular coating of release agent to the fixing roller while continuously removing excess toner and other contaminates from the roller. Once the sheathed wick member has become loaded with contaminates or begins to experience decrease oil delivery, it can be repositioned within the mounting sleeve to present a different face in contact with the fixing roller.

The applicator apparatus of the present invention provides a far more constant and longer-lived coating of release agent than has been previously available with conventional felt wick applicators. In addition, when supplied with a texturized surface, the applicator of the present invention cleans significantly better than previous expanded PTFE applicators, and even better than conventional felt wick applicators. Moreover, the applicator of the present invention can be readily cleaned and regenerated for additional use once expended. Also, the sheathed wick member provides a nonlinting surface. Finally, the applicator of the present invention is durable, requires minimal space, and can be stored, transported and operated at different angles with minimal risk of spillage or damage to printer.

DESCRIPTION OF THE DRAWINGS

The operation of the present invention should become apparent from the following description when considered in conjunction with the accompanying drawings, in which.

DETAILED DESCRIPTION OF THE INVENTION

The present invention provides an improved apparatus for use in delivering a chemical agent to a roller. The apparatus of the present invention is particularly applicable to the delivery of a release agent such as silicone oil to a fixing roller of a laser printer, plain paper copier or fax machine, or similar device. For simplicity, such devices will be collectively referred to herein as "printers."

Figure 1:
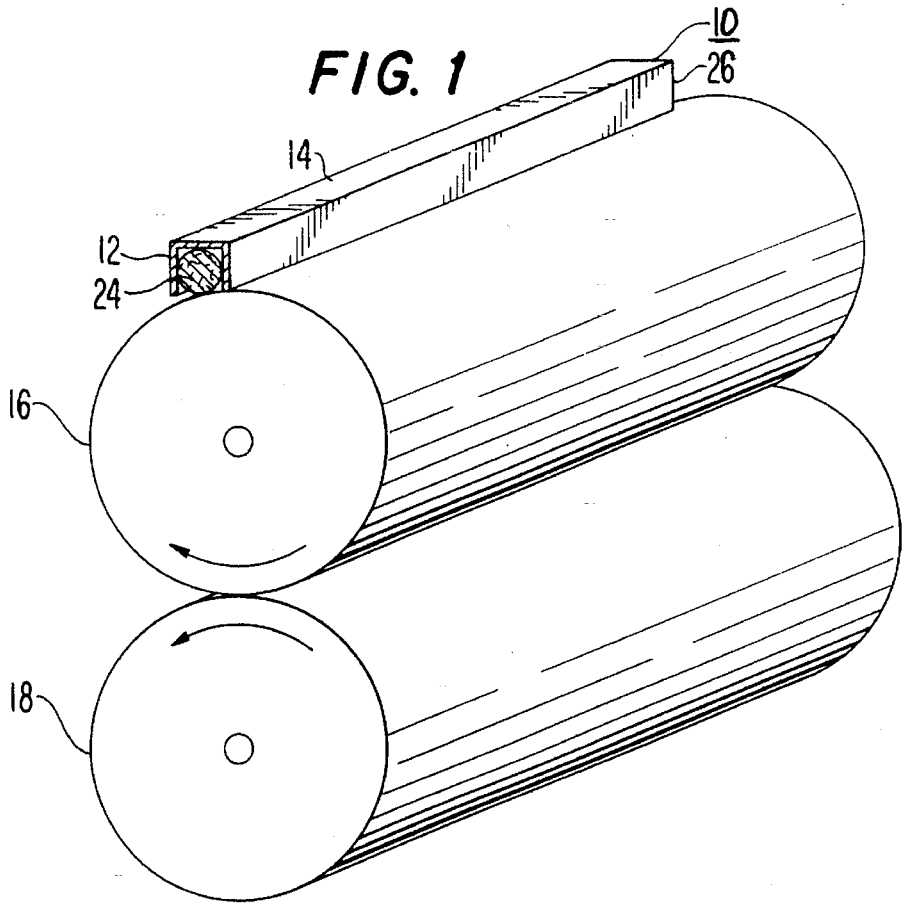
FIG. 1 is a three-quarter isometric view of one embodiment of a release agent applicator of the present invention shown oriented with fixing and pressing rollers.
Figure 2:
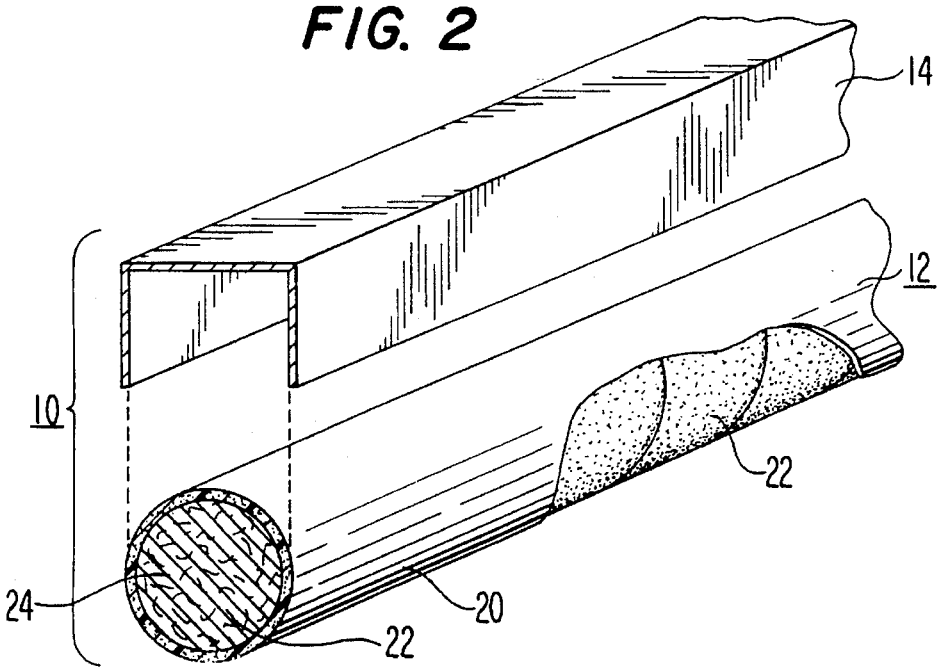
FIG. 2 is an enlarged, three-quarter exploded view of a sheathed wick member of the present invention and a mounting sheath, the sheath wick member shown with a portion of its porous membrane surface cut-away.

As is shown in FIGS. 1 and 2, the release agent delivery apparatus 10 of the present invention comprises a sheathed wick member 12 and a mounting sleeve 14. As is shown in FIG. 1, the apparatus 10 is mounted to place the sheathed wick member 12 in contact with a fixing roller 16 of a printer. The fixing roller 16 in turn is in direct contact with a resilient pressing roller 18. As is known, once an image has been applied to a piece of paper, the paper passes between the fixing roller 16 and the pressing roller 18 to seal toner to the paper.

In order to prevent the paper from attaching itself to the fixing roller 16, the release agent delivery apparatus 10 provides a coating to the fixing roller 16 on each revolution of the roller. Suitable release coatings for most applications include a silicone oil, such as polydimethylsiloxane. The delivery apparatus 10 also serves to wipe any excess toner or other residue or dust from the fixing roller 16 to avoid contamination of future printer pages.

The sheathed wick member 12 of the present invention comprises a permeable membrane, or a permeable membrane with a densified pattern, membrane 20 completely surrounding an absorbent textile core 22. The permeable polymer membrane 20 should be sufficiently porous to release agent that such release agent will pass readily through it when it is compressed against a fixing roller 16 in normal operation. Preferably the membrane 20 comprises a tube or tape of fluoropolymer and especially a fluoropolymer of polytetrafluoroethylene (PTFE). Permeable membranes of PTFE can be derived through a number of processes, including by forming an expanded network of polymeric nodes and fibrils in accordance with the teachings of U.S. Pat. No. 3,953,566, issued Apr. 27, 1976, to Gore. This material is commercially available in a variety of forms from W. L. Gore & Associates, Inc. of Elkton, Md., under the trademark "GORE-TEX."

Generally, a seamless tubular membrane should have the following properties: a thickness of about 0.002 to 0.125 inches; a porosity of about 30 to 98%; and a bubble point (with isopropyl alcohol) of 0.4 to 60 psi. The preferred tubular membrane properties are: a thickness of about 0.03 to 0.04 inches; porosity of about 70 to 80%; and a bubble point of about 3–5 psi.

The Bubble Point of porous PTFE was measured using a method similar to that set forth in ASTM Standard F316-86, with the following modifications: isopropyl alcohol was used instead of denatured alcohol; area tested was about 10 mm diameter (78.5 $mm^2$). The Bubble Point is the pressure of air required to blow the first continuous bubbles detectable by the their rise through a layer of isopropyl alcohol covering the PTFE media.

For a fluorinated ethylene propylene (FEP) coated tape membrane, the membrane should have the following properties: a thickness of about 0.0005 to 0.125 inches; and a porosity of about 30 to 98%. Preferably, a tape thickness is about 0.001 to 0.002 inches and a porosity of about 80 to 95%.

As is explained in greater detail below, it has been determined that supplying a texturized pattern on the surface of the cover provides significantly improved performance for the wick device of the present invention. One method of producing this pattern is through densification. For example, densification of a pattern can be achieved by imparting high pressure (with or without high temperature) to localized areas. The preferred pattern is achieved by pressing a wire screen into the membrane at a temperature of about 900° F. and a pressure 500 lbs. of force over a ½"×8" section for about 30 seconds. These conditions produce a pattern that is permanently set into the membrane.

Among other possible ways of producing a texturized pattern may include: using an embossing roller to roll down the material and impart a pattern (again, with or without heat applied); exerting pressure with a press having pattern dies; or feeding a screen overtop of the membrane through a high pressure and heated nip roller. It should be evident that a number of other methods may likewise be employed to achieve the desired amount of texturing for use in the present invention.

For a membrane sheath with a surface formed by extrusion, the geometry of the surface may be dependent on the shape of the die from which the material is extruded. A wide variety of different surface textures are possible with extrusion. The texturized surface is what is believed to be important for enhancing the cleaning capability of the wick.

An expanded PTFE membrane is preferred for a variety of reasons. First, the chemical inertness and relatively high heat resistance of PTFE makes it completely suitable for use as part of a wick in a printer environment. Second, expanded PTFE provides even distribution of release agent. Additionally, the rate of distribution of release agent can also be tightly controlled by adjusting one or more of a number of different properties. For instance, dimensions, porosity, pore size and other properties of the expanded PTFE membrane may be modified to provide specific properties. Additionally, the the pattern formed on the membrane may be varied, such as by extrusion or by altering the pattern, to adjust the amount of area of the membrane densified. All of these factors can contribute to assure more uniform dissemination and control of release agent over the operative life of the delivery apparatus. Third, expanded PTFE has a low coefficient of friction and exceptional wear characteristics, reducing wear on component parts and extending operational life of the apparatus. Fourth, PTFE can be readily cleaned of deposited toner and other contaminates, again extending the operative life of the apparatus.

Fifth, the ePTFE can be given a pattern by densifying identations into the membrane, or by extrusion. This pattern allows for the control of the surface roughness which can be used to maximize the cleaning capacity of the wick. In addition, the densified membrane can also help to control oil flow rates, by changing the surface area of porous membrane contacting the hot roll.

A preferred tape membrane for use with the present invention comprises an expanded PTFE material coated with a thermoplastic polymer with a melting temperature below that of the expanded PTFE. The thermoplastic layer should be ½ to 1/10 or less of the thickness of the PTFE material. The PTFE and thermoplastic polymer composite is heated to a temperature sufficient to soften or melt the thermoplastic polymer into the expanded PTFE surface but below that which will melt the PTFE (i.e. below about 342°C.). Thermoplastic polymers are preferred since they are similar in nature to PTFE (i.e. they have melt points near the lowest crystalline melt point of PTFE, and they are relatively inert in nature and therefore resist chemical attack). Suitable thermoplastic polymers for use with the present invention may include: fluorinated ethylene propylene (FEP), copolymer of tetrafluoroethylene and perfluoro(propylvinyl ether-)(PFA), homopolymers of polychlorotrifluoroethylene (PCTFE) and its copolymers with tetrafluoroethylene (TFE) or vinylidene fluoride, ethylenechlorotrifluoroethylene (ECTFE) copolymer, ethylene-tetrafluoroethylene (ETFE) copolymer, polyvinylidene fluoride (PVDFG), and polyvinylfluoride (PVF).

The preferred material for use as a tape in the present invention is a composite fluoropolymer film/membrane comprising a noncontinuous thermoplastic fluoropolymer layer (more preferably a non-continuous layer of fluorinated ethylenepropylene (FEP)) and an expanded PTFE layer.

The porous membrane, or porous membrane with densified pattern, is laid on the core 22 with the thermoplastic layer facing the core 22. Wrapping the wick with the porous membrane may be done by hand either spirally or in a "cigarette" fashion. Wrapping is preferably accomplished using a spiral tape wrap machine such as those known in the art of wrapping dielectric layers around conductors. One such machine is taught in U.S. Pat. No. 3,756,004, to Gore. The tape wrap machine applies the porous membrane with back tension in a helical fashion around the PTFE core. Back tension allows oil from the core to wet-out the tape rapidly.

The resulting composite material is heated to a temperature above the melt point of the thermoplastic fluoropolymer layer and at or below about 350° C. so that the contacting layers of the membrane adhere. The material should be kept under tension when heated. Heating can be done through any common method, including use of conduction or convection heat.

Housed within the membrane 20 is an absorbent textile core 22 which is filled with release agent. The textile core 22 may be a twisted or braided rope of fibrous strands which will provide a substantial reservoir of release agent. Additionally, the textile core 22 should be sufficiently resilient to deformation so as to provide support to the membrane 20 when it is placed in contact with roller 16. Other possibly suitable textile materials include cords, yarns, tow, silver, fabric, or felt. These may be constructed from materials such as fiberglass, aramids, copolyimides, polyimides, fluoropolymers (e.g. chlorotrifluoroethylene (CTFE) or polytetrafluoroethylene (PTFE)), polyphenylene sulfide (PPS), modacrylic, novoloid, polyester, acrylic, or similar materials or combinations or blends of such materials. Additionally, the textile core may comprise an open cell foam, such as silicone, urethane, melamine, fluoropolymer, and mixtures thereof. The primary concern is to select a material which is suitable for use in a printer environment (e.g. being resistant to attack by the release agent; being able to handle operating temperatures of the fixing roller, etc.).

The membrane 20 illustrated in FIG. 2 comprises a continuous tube of expanded PTFE placed around textile core 22. This construction may be achieved by any conventional means, including by extruding membrane 20 around the textile core 22 or by pulling the textile core 22 into the membrane 20. The textile core 22 may be filled with the release agent prior to insertion into the membrane 20, or it may be filled after insertion by injection under pressure or vacuum or by merely soaking the sheathed wick member 12 within a release agent material.

It has been found that the textile core 22 provides a sufficiently absorbent substrate so that the release agent will remain therein without conscientious sealing of the membrane 20 around the textile core 22. As such, each end 24 of the sheathed wick member 12 may be left open. Although not necessarily required, this open construction provides a number of benefits, including giving easy access for replenishing release agent; limiting the size of the sheathed wick member 12 to only its operational length—eliminating additional space which might be required for end caps or other sealing means; reducing labor and material costs for construction; etc. An additional benefit is that open ends allow the unit to pressure equalize (i.e. to function properly, sealed units should include added means to achieve pressure equalization, or else the flow of oil from the unit will steadily decrease due to vacuum formation within the unit).

The delivery apparatus 10 may be mounted in contact with the fixing roller 16 in any suitable manner. As is known, most printer devices include clips or brackets adapted to receive a wick and retain it in contact with the fixing roller 16. It should be evident from the above description that the mounting sleeve 14 of the present invention can be readily provided with appropriate hardware to interface with such mounting systems.

Figure 3:
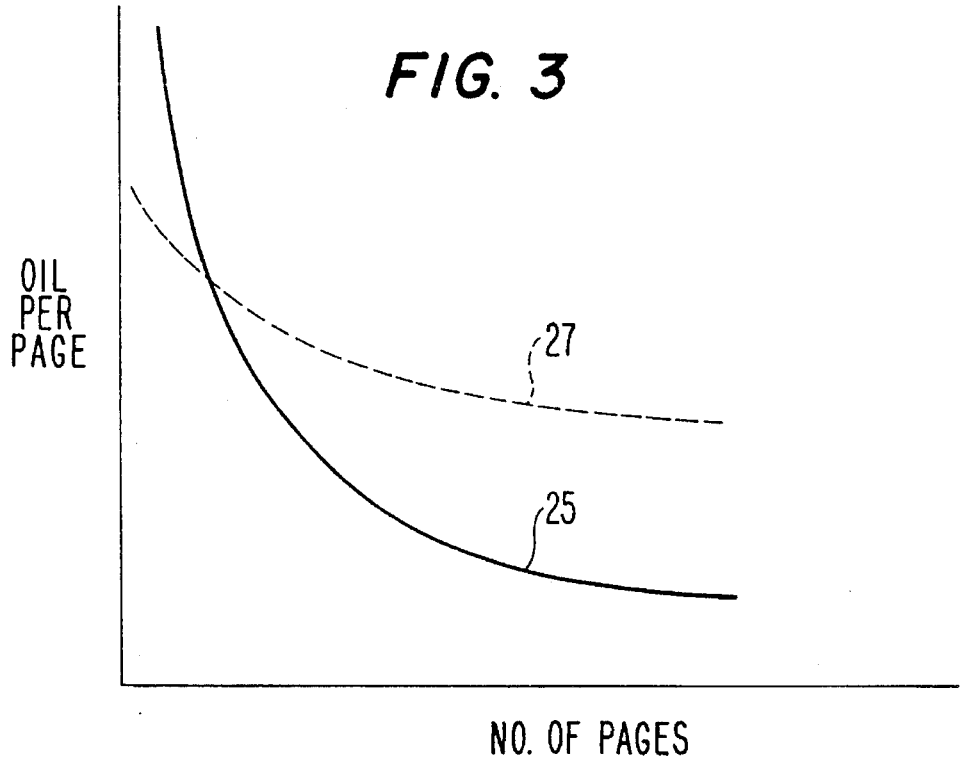
FIG. 3 is a graph illustrating release agent delivery verses number of pages printed of a conventional felt and silicone oil wick and a wick of the present invention.

Shown in FIG. 3 is a hypothetical graph depicting the relative delivery of release agent per page over a number of pages for a conventional felt/oil wick 25 and a sheathed wick member 27 of the present invention. As can be seen by this graph, a conventional wick tends to provide far too much oil upon immediate installation and then falls off rapidly to provide too little oil. By contrast, a wick of the present invention provides a more consistent oil coating to the fixing roller over its operational life, and, as a result, should tend to have an extended duty cycle, and provide better image quality.

Figure 4:
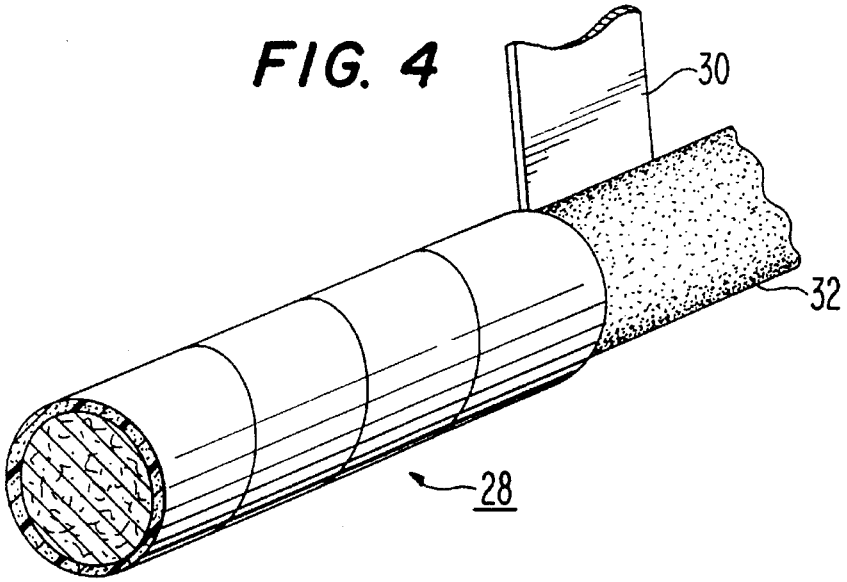
FIG. 4 is an enlarged, three quarter isometric view of another embodiment of a spiral-wrapped sheathed wick member of the present invention.

Another embodiment of a sheathed wick member 28 of the present invention is shown in FIG. 4. In this form, the wick member 28 is formed by spiral wrapping a porous membrane 30 around a textile core 32 in the manner described above.

A composite tape of expanded PTFE membrane and FEP tape with the following properties is preferred. The tape is ideally a porous, non-continuous FEP coated expanded PTFE tape which has been highly expanded in the machine direction about 80:1 or more. The high degree of expansion imparts high strength to the material in the direction of expansion. Overall dimensions of the tape is preferably about 1 inch wide and 0.001 to 0.005 inch thick. The tape is applied to the core with an overlap of about ½ (i.e. covering the core about two times).

The textile core 32 in the embodiment of FIG. 4 comprises a 0.0374 inch diameter matrix braid fiberglass rope with a base weight of about 30 grams/foot. The rope is impregnated with silicone oil (e.g. "DOW CORNING"200 fluid).

Figure 5:
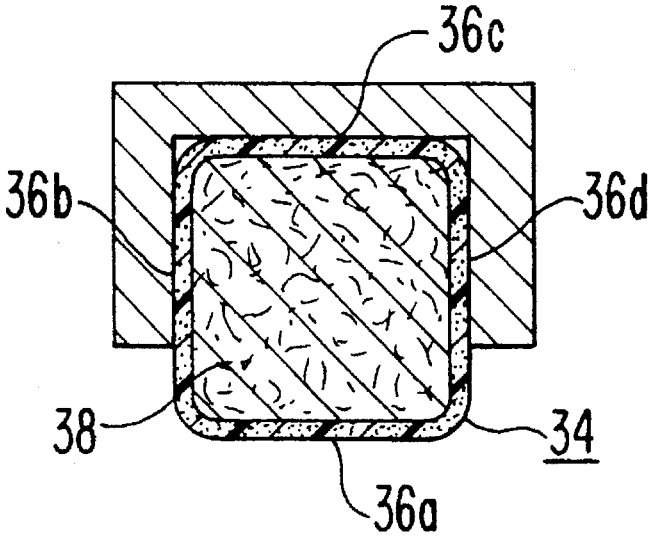
FIG. 5 is a cross-sectional view of yet another embodiment of a sheathed wick member and mounting sleeve of the present invention.
Figure 6:
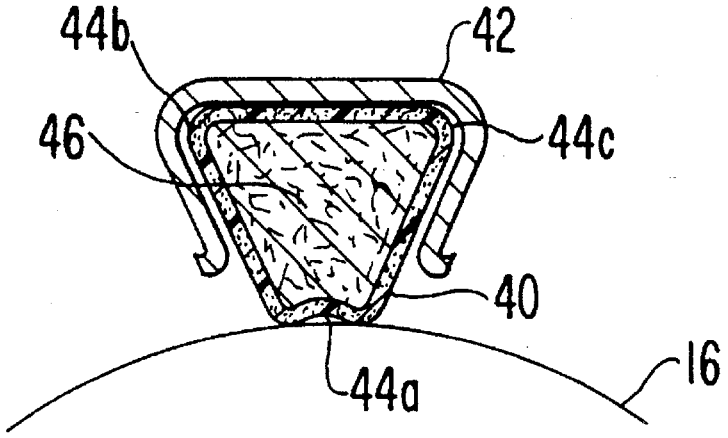
FIG. 6 is a cross-sectional view of still another embodiment of a sheathed wick member and mounting sleeve of the present invention.

Other examples of possible embodiments of the sheathed wick members of the present invention are illustrated in FIGS. 5 and 6. The embodiment of FIG. 5 demonstrates that the sheathed wick member 34 can be formed in an essentially rectangular shape. This form has a number of advantages in that it provides an extended contact surface 36*a* against which to contact a fixing roller 16. With the use of a resilient textile core material 38, such as needle punched felts, tow fiber, or open cell foams, the contact surface would be expected to conform somewhat to the shape of the fixing roller for improved cleaning and release agent application. As should be evident, the sheathed wick member 34 may be readily removed and reinserted to provide up to four fresh contact surfaces 36*a*, 36*b*, 36*c*, 36*d* before the wick member must be cleaned or replaced.

The embodiment shown in FIG. 6 is yet another example of a sheathed wick member 40. In this form, the sheathed wick member 40 comprises an essentially triangular shape which is retained in place by contoured mounting sleeve 42. Preferably, the wick member 40 is mounted against the fixing roller 16 to place its pointed ends 44*a*, 44*b*, 44*c* in contact with the fixing roller 16. Again, the textile core 46 material should comprise a deformable material, such as a needle punched felt or an open cell foam, to improve surface contact area.

Figure 9:
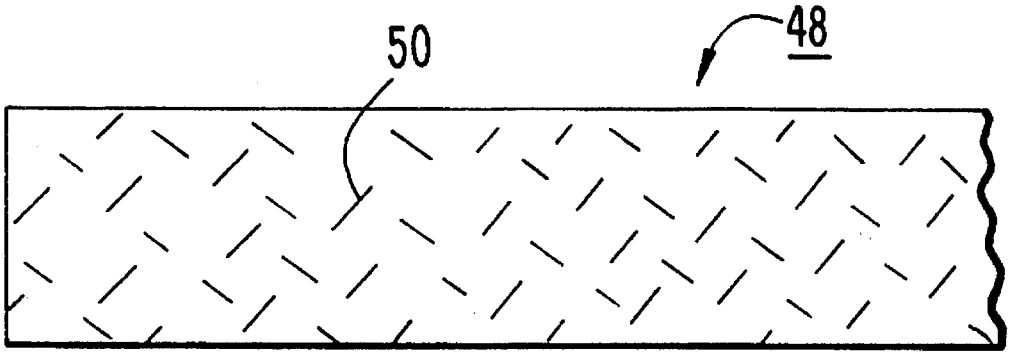
FIG. 9 is a top plan view of a sheathed wick member of the present invention incorporating a densified pattern.
Figure 10:
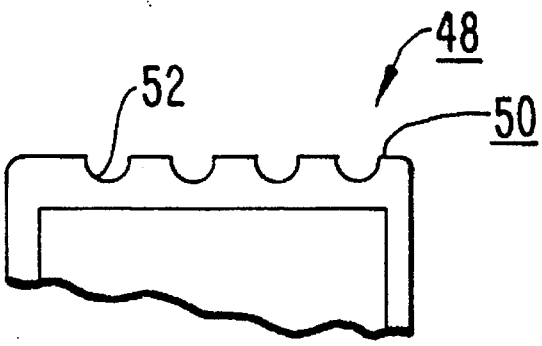
FIG. 10 is a schematic representation of an enlarged cross sectional view of another embodiment of a sheath around the wick member of the present invention including a textured pattern thereon.

Another embodiment of the sheathed wick member is illustrated in FIGS. 9 and 10. The embodiment of FIG. 9 shows in greater detail wick member 48 of the present invention with a pattern 50 pressed into it. As has been explained, this pattern may be formed by densifying the membrane using any number of different methods. One method is: to pull an ePTFE tube over a square steel rod; to wrap a layer of "KAPTON®" polymer from E. I. duPont and Nemours and Company, Wilmington, Del., or similar film around the circumference of the tubing that fits over the rod; to lay a piece of fine metal screen across one side of the ePTFE-rod assembly in order to obtain a controlled texture; to apply heat and pressure to press an imprint of the screen image onto the tubing; and to allow the tube to cool and then to remove the rod. Not only can this pattern be achieved by pressing the pattern of a screen, but by pressing wire mesh, wire, or any object that leaves an impression onto the permeable membrane. FIG. 10 illustrates in somewhat exaggerated representation the nature of the texturing achieved in one surface of a wick through a texturing process. As can be seen, the wick 48 includes a pattern 50 of multiple indents 52 in its surface.

Due to a combination of high heat and pressure, the ePTFE membrane melt flows in the areas below the wire overlapping points, causing a densified pattern. The resulting texturized tube surface has many benefits over conventional flat surface membrane sheaths. The pattern allows for much better cleaning of the fuser roll. The indentations in the membrane allow the particulate from the fuser roll to collect. The densified pattern is a way of controlling abrasion against the fuser roll. In addition, the densified pattern allows for better control of the wicking rate. By varying the percentage of the membrane surface area that is densified, the oil flow rate or wicking rate can be controlled, The more surface area that is densified, the lower the wicking rate.

Figure 11:
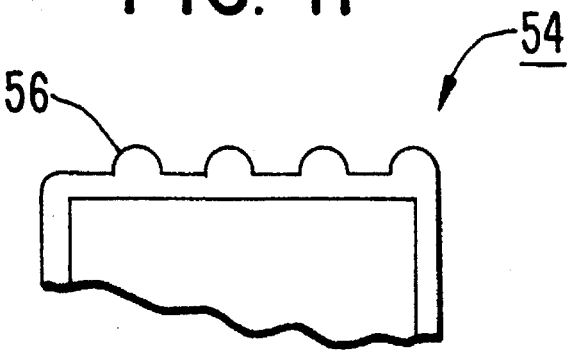
FIG. 11 is a schematic representation of another embodiment of a sheath of the present invention including an enlarged raised texturized pattern, such as that which may be formed by extrusion.

Another embodiment of the sheath wick member is illustrated in FIG. 11. The embodiment of FIG. 11 demonstrates that a sheathed wick member 54 may have a controlled surface 56. This controlled surface texture can be made through extrusion of the membrane sheet or tube through dies that have grooves to form the surface structure.

Any number of different surface structures and densified patterns could be imagined, or could be produced through a number of different methods without departing from the intent of the present invention.

Another benefit of the present invention is illustrated in the following table. This table documents a Helmke Tumble Test comparing a wick member of the present invention with a conventional "NOMEX®" felt wick member (NOMEX is a trademark of E. I. duPont de Nemours and Company, and designates an aramid fiber material). The Helmke Tumble Test is based on the recommended practice Issue Number RP3 of Garment Systems and Considerations for Clean Rooms and Controlled Environments. The test is set forth in detail in G. Helmke, "Tumble Test for Determining the Level of Detachable Particles Associated with Clean Room Garments and Cleanroom Wipers," 1982 *Proceedings of the Annual Technical Meeting of the Institute of Environmental Sciences* pp. 218–220. The specific test procedure used is set forth below.

In the tumble test, actual wick samples were placed in a tumbling metal drum, shaking off any loose particles. The tumble tester used was acquired from Kenetics Hydro, Inc., Shippensburg, Pa., model RTC3000. An analyzer sucks air from the rotating drum with sample, and sends the air stream through a white light the air is sampled once every minute for 10 consecutive minutes (each sample being a "trial"). Mirrors in the analyzer collect the light scattering, and it senses the amount of light that is scattering. A large degree of scattering implies that the particles are large. The data collected shows that many more particles are released from the standard felt wick material. Linting particles become attached to the fuser roll, and can be transferred to the pages. This results in copy quality imperfections as noted by smudges and spots. In extreme cases, felt fibers become dislodged from felted member and wrap around hot roll, causing streaks in print quality due to uneven oil transfer. This is avoided using the sheathed wick member, which released very few particles.

The test results achieved are set forth in the following tables:

| WICK MEMBER OF THE PRESENT INVENTION INCORPORATING AN EXPANDED PTFE MEMBRANE | | | |
|---|---|---|---|
| TRIAL | #PARTICLES ≧0.3 MICRON | #PARTICLES ≧0.5 MICRON | #PARTICLES ≧0.7 MICRON |
| 1 | 19 | 10 | 6 |
| 2 | 7 | 7 | 4 |
| 3 | 6 | 4 | 3 |
| 4 | 3 | 2 | 0 |
| 5 | 21 | 14 | 12 |
| 6 | 7 | 5 | 2 |
| 7 | 1 | 1 | 0 |
| 8 | 21 | 14 | 8 |
| 9 | 1 | 0 | 0 |
| 10 | 6 | 5 | 4 |
| AVERAGE | 9.2 | 6.2 | 3.9 |

| NOMEX ® FELT WICK | | | |
|---|---|---|---|
| TRIAL | #PARTICLES ≧0.3 MICRON | #PARTICLES ≧0.5 MICRON | #PARTICLES ≧0.7 MICRON |
| 1 | 2725 | 876 | 203 |
| 2 | 3319 | 1005 | 222 |
| 3 | 3157 | 891 | 176 |
| 4 | 2730 | 775 | 151 |
| 5 | 2380 | 613 | 129 |
| 6 | 2109 | 574 | 114 |
| 7 | 1918 | 536 | 94 |
| 8 | 2364 | 666 | 108 |
| 9 | 2243 | 571 | 103 |
| 10 | 1746 | 443 | 58 |
| AVERAGE | 2469.1 | 695 | 135.8 |

The above tables make it clear that the risk of particle contamination is greatly reduced through use of a wick member of the present invention.

It should be evident from these examples that a wide variety of other shapes may likewise be provided for the sheathed wick member and mounting sleeve of the present invention without departing from its intent.

One of the advantages of the apparatus of the present invention is that it can be cleaned and regenerated for further use. The preferred cleaning and regenerating steps comprises wiping the collected residue from the surface of the wick using an absorbent cloth, then wiping the remaining surface with a cloth saturated with silicone oil. The core is then re-injected with silicone oil, either manually with a syringe or automatically with a pressurized oil delivery syringe system.

A simplified procedure for regenerating the wick comprises simply rotating the sheathe and core approximately 90 degrees and then, if necessary, reinjecting with silicone oil as described above.

Without intending to limit the present invention, the following represent examples of sheathed wick members which were made and used in accordance with the present invention:

EXAMPLE 1

An expanded porous polytetrafluoroethylene tubing with an outer diameter of about 9 mm and an inner diameter of about 7 mm was used to make fuser oil application wicks for a laser printer. Each tube was filled with a core of various material and filled with a "DOW CORNING200" silicone oil acquired from Dow Coming Corp. of Midland, Mich.

Samples were prepared in the following manner:

For a core of polyester felt ("POLYFELT®" (POLYFELT is a trademark of Chemie Holding AK, and designates a polyester felt material)) 2720 g/m$^2$ (65 oz./yd$^2$) by 9.5 mm (3/8") thick polyester felt was cut into 9.5 mm×6.4 mm×28 cm (3/8"×3/8"×11") strips. These strips were weighed and evenly coated with 12 grams of "DOW CORNING 200" silicone oil fluid (10,000 centistoke). The oiled strips were placed horizontally on a glass dish so that the oil could evenly distribute throughout the polyester felt. The oiled felt was then pulled through a 38 cm (15") long expanded PTFE tube. Pulling through the tube was accomplished by attaching a safety pin to the felt and tying a metal wire to the safety pin and passing the wire through the tube. Once the expanded PTFE tube was pulled over the oiled felt, both the tube and the felt were cut to 21.6 cm (8.5") in length and weighed.

Wicks prepared in accordance with the above procedures were then tested with various weights and viscosities of silicone oils in a drip test. Each sample was clamped in a ring-stand and hung vertically for a period of days. A paper towel was placed below the hanging sample to catch any oil that flowed out. Drips of oil that were observed on the paper towel were noted. Wicks "passed" the drip test when absolutely no drips were observed after ten (10) days. Dripping is undesirable to assure that release oil will not leak out of the wick and into components of the machine. Drip tests were conducted by varying the material, oil weight, and oil viscosity. The following results were observed:

| WICK DRIP DATA | | | |
|---|---|---|---|
| Sample No. | Material | Oil Wt. (g) | Oil Viscosity (Centistokes) |
| 1 | Fiberglass rope | 12.0 | 30,000 |
| 2 | Polyester felt | 12.2 | 30,000 |
| 3 | "NOMEX ®" felt | 12.3 | 30,000 |
| 4 | "Poly felt ®" | 12.7 | 10,000 |
| 5 | "Poly felt ®" | 6.3 | 10,000 |
| 6 | "NOMEX ®" felt | 12.1 | 10,000 |
| 7 | "NOMEX ®" felt | 6.5 | 10,000 |
| 8 | Fiberglass rope | 6.3 | 10,000 |
| 9 | Fiberglass rope | 12.1 | 10,000 |
| 10 | "MELAMINE ®" foam | 6.0 | 30,000 |

"MELAMINE ®" is a trademark of Melamine Chemicals Inc. and designates polymer foam material.

Each of the materials of Samples Nos. 1 through 9 were installed within expanded PTFE tubes in the manner described above. After ten days, no oil drips were observed from any of Samples Nos. 1 through 8. Sample 9 did experience dripping after ten days and is considered to have "failed" the drip test. Sample 10 also failed the drip test, with dripping beginning after only 24 hours.

Figure 7:
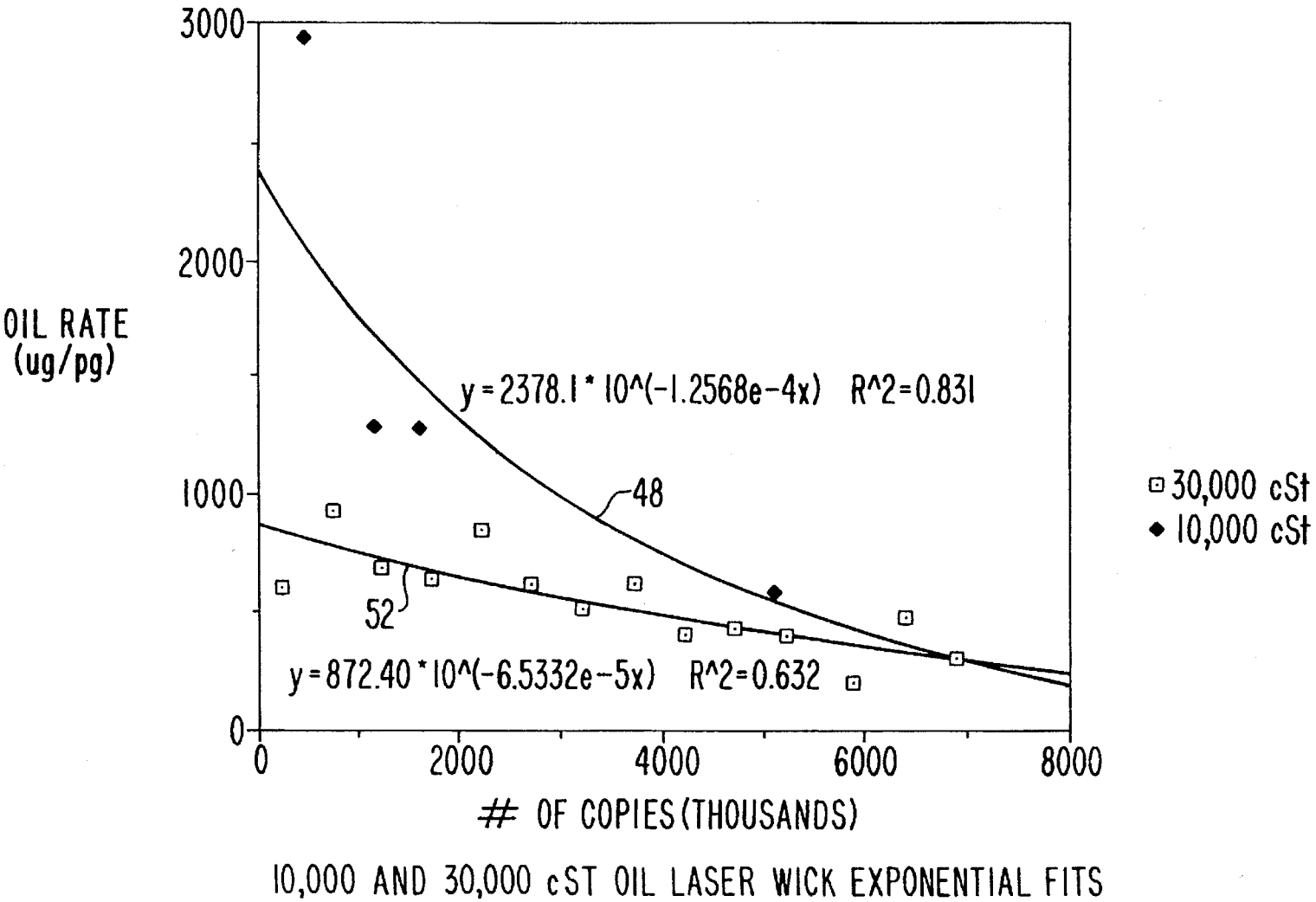
FIG. 7 is a graph depicting the rate of oil distribution verses number of copies generated on a laser printer for two different wick members of the present invention.
Figure 8:
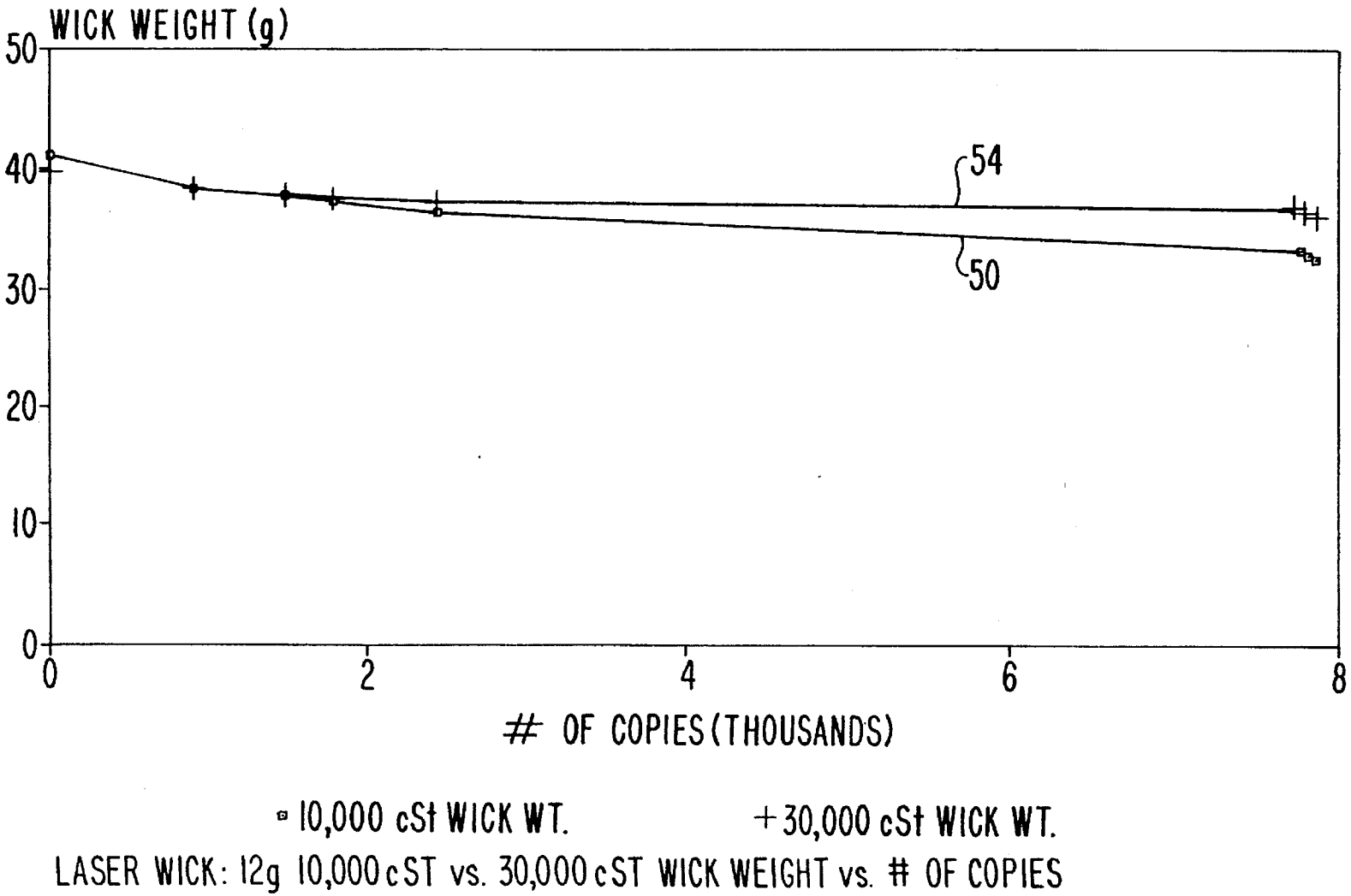
FIG. 8 is a graph depicting changes in wick member weight as a function of number of copies generated on a laser printer for two different wick members of the present invention.

To test the wick's functionality, pre-weighed wicks similar in construction to that of Sample 2 and 4 above were inserted into a QMS PS820 laser printer. A total of 8,600 copies were generated with these wicks in place. After various numbers of intermittent copies were run, including as few as 20 copies and as many as 900 copies, the wicks were removed from the printer and re-weighed. By taking difference in the weights before and after the copies were run, the intermittent and total oil transfer rates were calculated. Graphs of wick weight verse number of copies and of oil delivery rate verses number of copies were produced in order to quantify the oil transfer as a function of the printer runs. These results are plotted as lines 48 and 52 on the graph of FIGS. 7. The weight loss of the wick as a function of the number of copies printed is shown as lines 50 and 54 on the graph of FIG. 8. Transfer rates were considered somewhat higher than desired.

EXAMPLE 2

A polyester felt of 2720 g/cm$^2$ basis weight with a thickness of 9.5 mm was again cut into 9.5 mm×6.4 mm×12.7 cm strips. The strips were pulled through ePTFE tubing using the safety pin and metal wire procedure previously described. Once the felt was installed in the tubing, the felt was oiled using 12.04 g of DOW CORNING 200 fluid 30,000 centistoke silicone oil. Oil was injected at both ends using a 12.7 cm (5") long needle and syringe. The oiled sample was then placed horizontally on a glass dish to allow the oil to flow evenly through the sample. The oiled sample was then cut to 21.6 cm (8.5") in length and was weighed.

After passing the drip test, the oiled wick was again placed in a QMS PS820 laser printer, and an total of 7,100 copies were generated, After every 500 copies, the wick was removed and re-weighed in order to calculate the total and intermittent oil transfer rates. This trial resulted in an oil transfer rate significantly lower than that achieved in Example 1. The oil transfer rate was considered acceptable for use in a printer device.

EXAMPLE 3

An expanded porous PTFE tubing with an outer diameter of about 9 mm and an inner diameter of about 7 mm was used to make fuser oil application wicks for a laser printer. Each tube was filled with a core of polyester felt and filled with a Dow Corning 200 silicione oil acquired from Dow Corning Corporation of Midland, Mich.

Samples were prepared in the following manner:

A 38 cm (15") long expanded PTFE tube was pulled over a 9.5 mm×6.4 mm×50.8 cm (⅜"×⅜"×20") square steel rod. A layer of "KAPTON®" (KAPTON is a trademark of E. I. duPont de Nemours and Company, and designates a polyimide sheet material), film acquired from E. I. duPont de Nemours and Company was wrapped around the circumference of the tubing that fit over the rod. A piece of fine metal screen with a 1½ mm opening and a 0.30 mm wire diameter and at least 20.3 cm (8 inches) in length was laid across one side of the rod-ePTFE assembly in order to obtain a texture. It was laid between two plates of a PHI Press. The press settings include:

Upper plate—454° C. (850° F.)

Lower plate—60° C. (140° F.)

Press time—0.5 min

Pressure—861 kPa (125 lbs/ft$^2$).

The layer of "KAPTON®" material is helpful to prevent sticking of the ePTFE tubing to the press plates. Once the screen image was imprinted onto the tubing, it was allowed to cool. Then, the rod was removed from inside of the tubing, and polyester felt was inserted.

Polyester felt, 2720 g/m$^2$ (65 oz./yd$^2$) by 9.5 mm (⅜") thick was cut into 9.5 mm×6.4 mm×28 cm (⅜"×⅜"×11") strips. The felt was then pulled through the 38 cm (15") long expanded PTFE tube. Pulling through the tube was accomplished in the manner previously described. Once the expanded PTFE tube was pulled over the felt, the felt was oiled using 10.9 g of Dow Corning 200 fluid 60,000 centistoke silicone oil. Oil was injected at both ends using a 12.7 cm (5") long needle and syringe. The oiled sample was then placed horizontally on a glass dish to allow the oil to flow evenly through the sample. The oiled sample was then cut to 21.6 cm (8.5") in length and was placed in a wick housing.

To test the wick's functionality, the preweighed wick was inserted into a "LEXMARK®" Laser Jet printer, Model 4039-16L. A total of 6,000 copies were generated with the wick in place. After every 500 copies, the wick was removed from the printer and was reweighed. By taking the difference in the weights before and after the copies were run, the intermittent and total oil transfer rates were calculated. Graphs of wick weight verses number of copies and of oil transfer rate versus number of copies were produced in order to quantify the oil transfer as a function of the printer runs. These results are plotted in the graph of FIG. 12.

Figure 12:
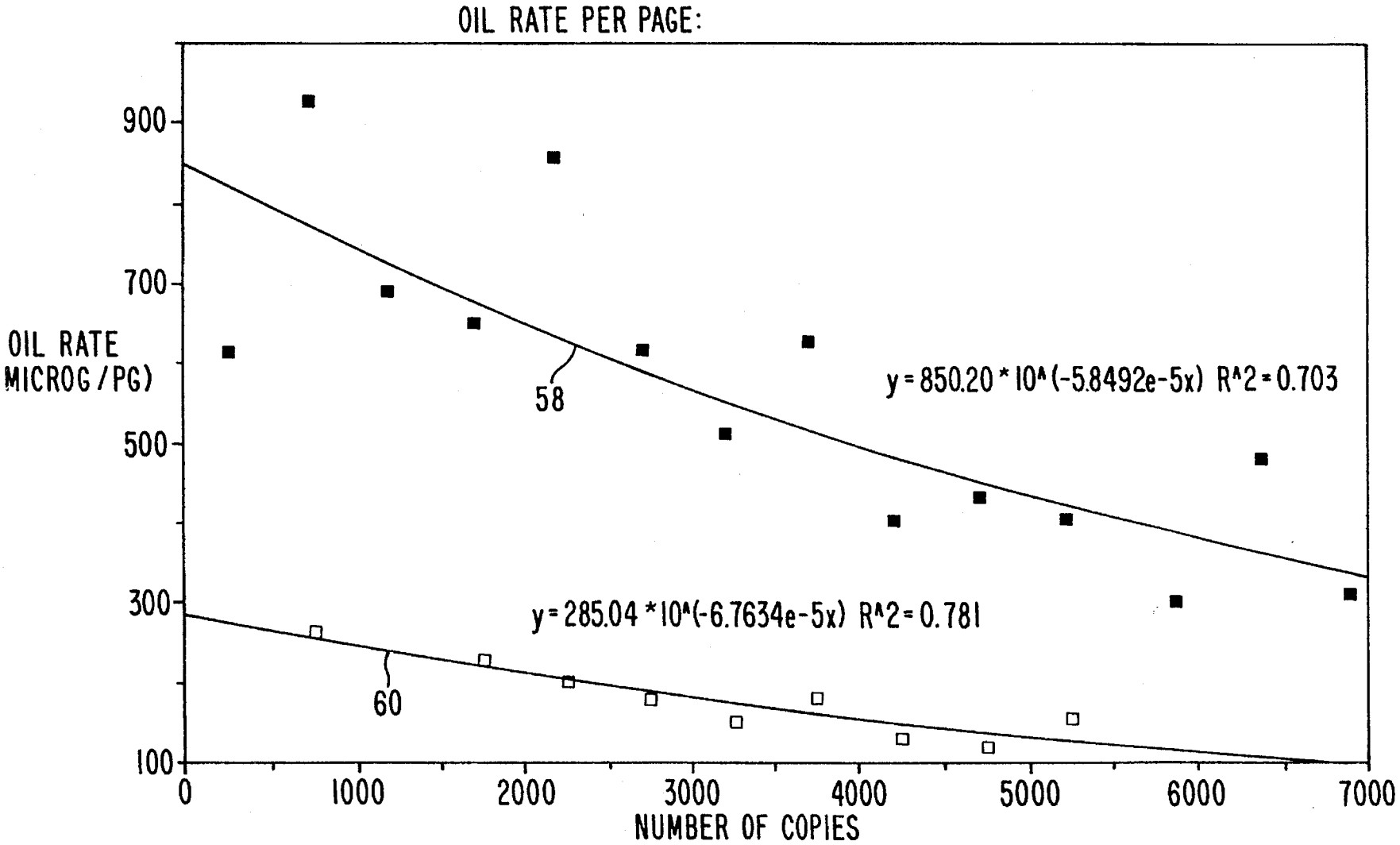
FIG. 12 is a graph illustrating the rate of oil distribution versus number of copies generated on a laser printer for two different wick members of the present invention.

As is shown in FIG. 12, line 58 is a graph of a wick having an expanded PTFE membrane with no texturing and line 60 is a graph of a wick having an expanded PTFE membrane with texturing provided in the manner described. As can be seen, there is a significantly more uniform rate of oil distribution when texturing is applied.

EXAMPLE 4

Again, a 38 cm (15") long expanded PTFE tube was pulled over a 9.5 mm×6.4 mm×50.8 cm square steel rod. The "KAPTON®" film was wrapped around the ePTFE. A finer metal screen 20.3 cm in length with a 1 mm opening and a 0.26 mm wire diameter was laid across one side of the assembly. A PHI press was used to densify a pattern onto the tubing, The press settings were:

Upper plate—454° C.

Lower plate—60° C.

Press time—0.5 min

Pressure—861 kPa.

Once it cooled, the rod was pulled from the inside of the tubing, and polyester felt was inserted in the same manner described previously. The felt was then oiled using 9.7 g of Dow Corning 200 fluid 60,000 centistoke silicone oil. The oiled sample was placed horizontally on a glass dish to allow the oil to flow evenly through the sample. The oiled sample was then cut to 21.6 cm (8.5") in length and was weighed.

The oiled wick was again placed in a Lexmark Laser Jet printer Model 4039-16L, and a total of 3,000 copies were generated. After every 500 copies, the wick was removed and reweighed in order to calculate the total and intermittent oil transfer rates. This trial resulted in a similar oil transfer rate as achieved in Example 1. The oil transfer rate was considered acceptable for use in a printer device.

After 3,000 copies, the wick was removed and a paper towel dabbed in silicone oil was used to successfully clean the wick surface. The wick was then recharged with enough oil so that 9.7 total grams of oil was again present. It was then reinserted into the laser printer. The oil transfer rate was noted to be similar to the original transfer rate.

While particular embodiments of the present invention have been illustrated and described herein, the present invention should not be limited to such illustrations and descriptions. It should be apparent that changes and modifications may be incorporated and embodied as part of the present invention within the scope of the following claims.

The invention claimed is:

1. A method for producing and positioning a release device agent supply to a roller, which comprises:

providing an absorbent textile core;

filling the absorbent textile core with release agent;

surrounding the absorbent textile core with a porous membrane of fluoropolymer to form a tubular sheathed wick member defining said release agent supply device through which the release agent is delivered;

forming a textured pattern in the membrane comprising densified indented areas through which less release agent is delivered; and mounting the sheathed wick member so as to provide a fixed contact surface against the roller.

2. The method of claim 1 that further comprises:

inserting the sheathed wick member within a sleeve, the sleeve adapted to hold the sheathed wick member in contact with the roller.

3. The method of claim 2 that further comprises retaining the sheathed wick member within the sleeve through means which allow it to be readily removed.

4. The method of claim 2 which further comprises providing the sheath wick member with multiple surfaces each having said densified indented areas through which release agent is delivered suitable for contact with the roller;

removing the sheathed wick member from the sleeve after a period of use with a first surface in contact with the roller;

rotating the sheathed wick member; and reinserting the sheathed wick member within the sleeve to position a second surface in contact with the roller.

5. The method of claim 4 that further comprises injecting additional release agent into the textile core prior to reinserting the wick member into the sleeve.

6. The method of claim 1 where said fluoropolymer comprises an expanded polytetrafluoroethylene (PTFE).

7. The method of claim 6 which further comprises surrounding the membrane of PTFE around the textile core so as to advance the flow of release agent through the membrane when the sheathed wick member encounters pressure from the roller once mounted in place.

8. The method of claim 7 which further comprises providing the membrane of PTFE in the form of a tape; and spiral wrapping the membrane around the textile core.

9. The method of claim 7 which further comprises providing the membrane of PTFE in the form of a continuous tube; and surrounding the textile core with the continuous tube.

10. The method of claim 1 which further comprises regenerating the sheathed wick member after a period of use by cleaning its exterior surface and refilling the textile core with additional release agent.

11. The method of claim 1 which further comprises extending the operative life of the sheathed wick member after a period of use by rotating the exterior surface of the wick member to place a different portion of its exterior surface in contact with the roller.

12. The method of claim 1 wherein the textured pattern is formed in the membrane by applying pressure to selectively densify portions of the membrane.

13. The method of claim 12 wherein the textured pattern is formed in the membrane through a combination of applied pressure and heat.

* * * * *

UNITED STATES PATENT AND TRADEMARK OFFICE

CERTIFICATE OF CORRECTION

PATENT NO. : 5,478,423
DATED : December 26, 1995
INVENTOR(S) : Sassa, et. al.

It is certified that error appears in the above-identified patent and that said Letters Patent is hereby corrected as shown below: Title page, item

[75] Change "Wiliamson" to –Williamson--.
Col. 7, line 3: delete the first occurrence of the word "the".
Col. 9, line 20: change "DOW CORNING"200" to –DOW CORNING 200"
Col. 10, line 15: change the "," to a period.
Col. 10, line 52: change "white light the" to –white light. The--.
Col. 12, line 7: change "DOW CORNING200 to –DOW CORNING 200--.
Col. 12, line 8: change "Coming" to –Corning--.

Col. 12, under table entitled "Wick Drip Data", change "Poly felt®" to -- POLYFELT® (two occurrences).
Col. 13, line 28: change "an" to –a--.
Col. 13, line 29: change "generated, After" to –generated. After--.
Col. 13, line 43: change "Coming" to –Corning--.

Col. 14, line 52: change "Lexmark" to --LEXMARK®--.
Col. 15, line 6: delete the word "device".
Col. 15, line 6; after the word "supply" insert –device--.
Col. 15, line 23: change "that" to –which--.

Signed and Sealed this

Tenth Day of March, 1998

*Attest:*

*Attesting Officer*

BRUCE LEHMAN

*Commissioner of Patents and Trademarks*